US006729780B2

(12) United States Patent
Sampson et al.

(10) Patent No.: US 6,729,780 B2
(45) Date of Patent: May 4, 2004

(54) COLOR PROOFER WITH REGISTERING MEANS

(75) Inventors: Rudy Sampson, Blankenberge (BE); Stefaan Deman, Roeselare (BE); Serge Defever, Oudenburg (BE); Marc Chys, Tornhout (BE); Christophe Michiels, Ostend (BE); Jozef Feys, Middelkerke (BE); Patrick Staelens, Gistel (BE)

(73) Assignees: Agfa-Gevaert, Mortsel (BE); Mutoh Europe, Ostend (BE)

( * ) Notice: Subject to any disclaimer, the term of this patent is extended or adjusted under 35 U.S.C. 154(b) by 0 days.

(21) Appl. No.: 10/234,685

(22) Filed: Sep. 4, 2002

(65) Prior Publication Data

US 2003/0118388 A1 Jun. 26, 2003

Related U.S. Application Data

(60) Provisional application No. 60/332,054, filed on Nov. 21, 2001.

(30) Foreign Application Priority Data

Sep. 5, 2001 (EP) ..... 01000424

(51) Int. Cl.[7] ..... B41J 11/55; B65H 39/10

(52) U.S. Cl. ..... 400/74; 271/291

(58) Field of Search ..... 400/70, 74, 42; 101/484, 485, 222, 223, 230; 271/10.12, 3.02, 255, 15, 17, 232, 233, 234, 237, 240, 243, 244, 245, 248, 249, 250, 253, 291

(56) References Cited

U.S. PATENT DOCUMENTS

| | | | | | |
|---|---|---|---|---|---|
| 3,933,564 | A | * | 1/1976 | Jensen | 156/265 |
| 4,962,386 | A | | 10/1990 | Hakkaku et al. | |
| 5,088,848 | A | | 2/1992 | De Falco et al. | |
| 5,289,262 | A | * | 2/1994 | McConnell | 356/617 |
| 5,566,906 | A | * | 10/1996 | Kamada et al. | 242/563 |
| 5,577,719 | A | * | 11/1996 | Nicoll | 271/227 |
| 5,709,484 | A | | 1/1998 | Dorner | |
| 6,019,365 | A | * | 2/2000 | Matsumura | 271/227 |
| 6,209,866 | B1 | * | 4/2001 | Hosking et al. | 271/228 |

FOREIGN PATENT DOCUMENTS

EP 01 00 0424 3/2002

OTHER PUBLICATIONS

IBM Technical Disclosure Bulletin,"Accurate Document Aligner", vol. 39, No. 11, Nov. 1996, pp. 111–112.

* cited by examiner

*Primary Examiner*—Charles H. Nolan, Jr.
*Assistant Examiner*—Hoai-An D. Nguyen
(74) *Attorney, Agent, or Firm*—John A. Merecki; Hoffman, Warnick & D'Alessandro LLC

(57) ABSTRACT

A printing apparatus is described for two-sided colour proofing with improved registering of front- and back-side images. Improved registering is performed by:

web feeding device with de-curling system tumbler unit for turning the receiving medium alignment sensing and correction system.

9 Claims, 15 Drawing Sheets

COLOR PROOFER WITH REGISTERING MEANS

The application claims the benefit of provisional application No. 60/332,054 filed Nov. 21, 2001.

FIELD OF THE INVENTION

The present invention relates to an printing apparatus capable of handling large size sheets. More specifically the invention is related to a colour proofing apparatus having a dual-side mode.

BACKGROUND OF THE INVENTION

Printed products contain not only printed text but many photographic illustrations are included in all sorts of printed products such as leaflets, magazines etc . . .

Nowadays text and illustrations are usually provided in electronic form in order to electronically compose the publication wherein the photographs are used.

The photographs provided in an electronic format are usually provided as a continuous tone image. A continuous tone image is an image containing multiple grey (colour) levels with no perceptible quantization to them.

In order to reproduce the continuous tone images by a printing process having only a limited number of grey levels, a halftoning process is used.

Digital halftoning refers to the process whereby a digital (continuous tone) image is rendered with a computer-controlled graphics output device that is capable of generating only a limited number of grey (colour) levels. The input image is electronically screened to obtain a halftone image for each colour.

In order to inspect the correctness of the digital halftoning process on the final product printed on a printing press, the printed result is simulated using a colour proofing apparatus.

A modern colour proofing apparatus is capable of not only providing a simulated print of the photographs but of the whole printed product. Several large size colour proofers use an inkjet printing process to render the halftone images on a large sheet of paper or other receiving media. Sheet sizes used may vary but a used format may be typical 109.22 mm (43 inch)×76.2 mm (30 inch). The medium is usually of a paper type, typically 100–130 g/mm$^2$, but also other media type can be used e.g. polyester supports which can be coated with appropriate ink receiving coatings etc . . .

These large sheets can be fed from a magazine but are frequently dispensed from a web coupled to the machine enabling the use of different lengths of receiving material which is cut at appropriate length. Depending on the form of the receiving medium, it can hereinafter be named receiving web or receiving sheet and is given the same number in the drawings of the application.

Recently, in order to completely imitate the final product, colour proofers having dual-side capabilities have emerged. With these apparatuses it is possible to imitate the dual-side printed output product and to control the imposition scheme, i.e. order and orientation of different pages or a large sheet which e.g. is folded and cut to render a small booklet or folder with numbered pages. One such apparatus is the Spinjet® sold by Techsage®.

A new problem emerging is the lack of registering of the front- and backside images on the proofing product giving unsatisfactory results. In some colour proofers one can manually turn the receiving sheet and feed it again into the printer by hand using e.g. a registration edge as an aid. In other printers the medium is turned over automatically. Hitherto it has been a problem providing a good registering of the output image on the large size output media in use. Especially registering correctly the images on the front and back side of large output media used in the colour and imposition proofing apparatus has been a problem. The curl remaining in the paper further causes problems in feeding the paper correctly.

Until now non easy an reliable solution has been provided to this problem.

OBJECTS OF THE INVENTION

It is an object of the present invention to provide a apparatus having a mechanism capable of reliable and correctly registering an output image on a receiver.

It is a further object of the invention to provide a front to back registering system for a dual-side printing apparatus.

It is another object of the invention to provide an improved reversing mechanism for large size receiver media in a dual-side printing apparatus.

SUMMARY OF THE INVENTION

The above mentioned objects are realised by a apparatus having the specific features defined in claim 1. Specific features for preferred embodiments of the invention are set out in the dependent claims.

A printing method according to the invention is defined in claim 9.

Further advantages and embodiments of the present invention will become apparent from the following description and drawings.

DETAILED DESCRIPTION OF THE INVENTION

While the present invention will hereinafter be described in connection with the working of a preferred embodiments thereof, it will be understood that it is not intended to limit the invention to those embodiments but several variations can be used incorporating the specific features of the invention as claimed.

Figure 1:
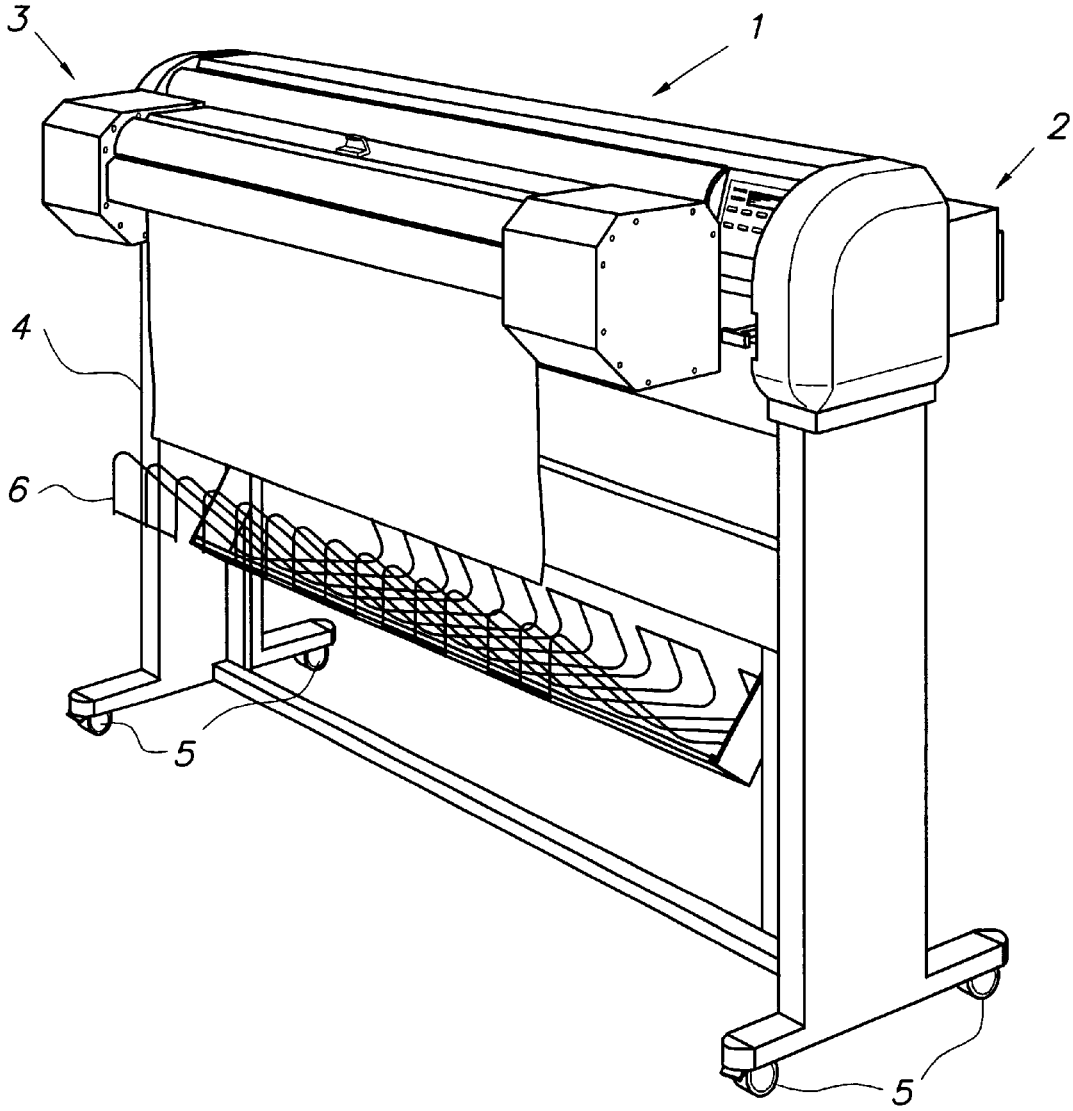
FIG. 1 shows an overall view of the printing apparatus.

FIG. 1 gives an overall view of the printing apparatus according to the invention.

The apparatus is composed of two main parts:

print unit 1 with roll media feeding device 2 on the back side.

tumbler unit 3 with paper alignment system on the front side.

The printing apparatus is usually supported by a light-weight pedestal 4 which can be provided with wheels 5 making it easy to move the printing apparatus. On the pedestal 4 is mounted a receiving basket 6 to store finished prints.

A preferred embodiment is now described using a description of the operation steps during dual side printing.

Web Feeding Step

Figure 2:
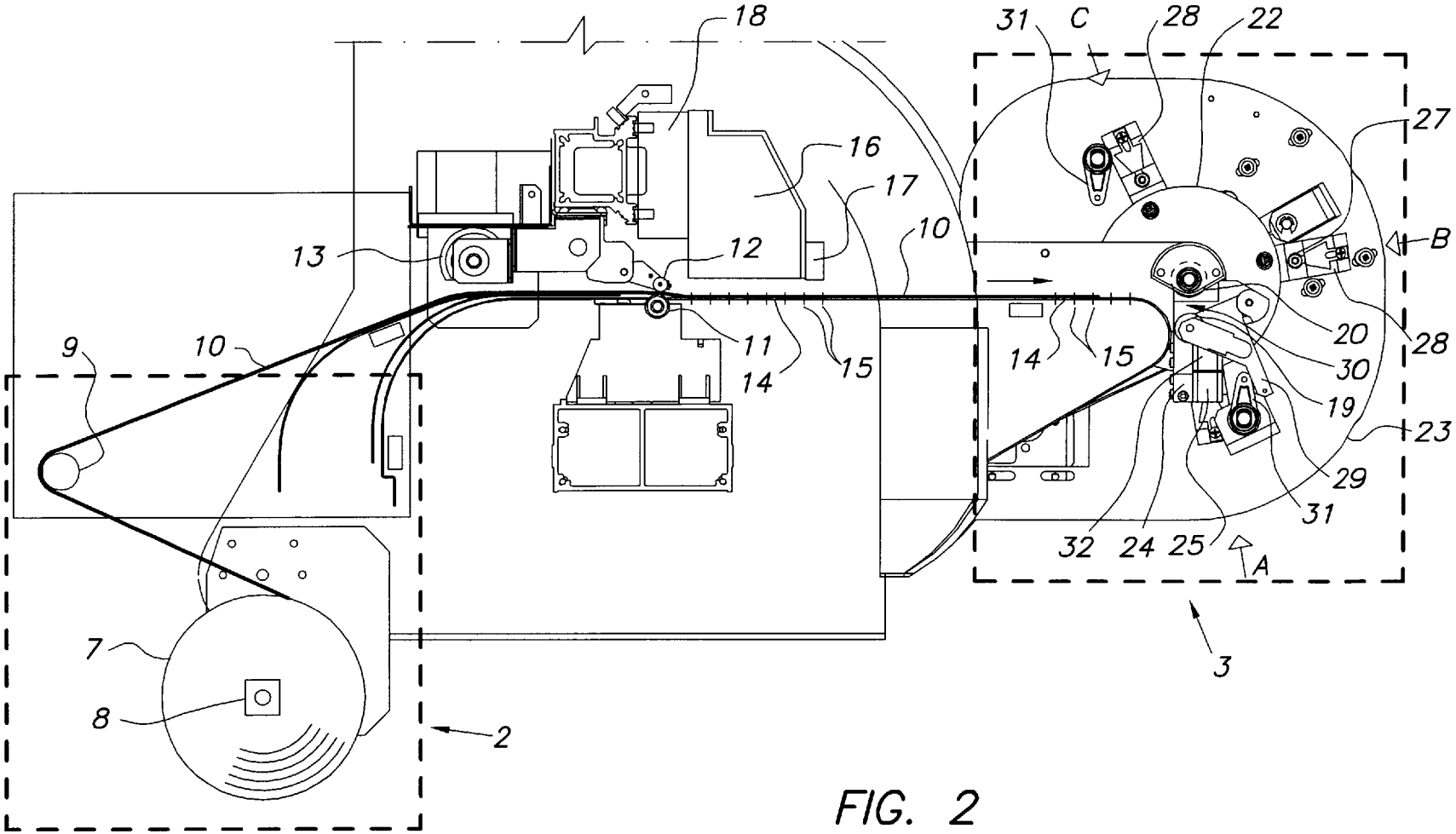
FIG. 2 shows the printing apparatus with web feed device and the tumbler unit in the initial position A FIG. 3 gives an isometric view of the tumbler mechanism with the rotatable platform in position B

Following description is given referring to FIG. 2 showing the printing apparatus with the roll media feeding device 2 on the back-side of the print unit 1

The roll media feeding device 2 comprises:

a media roll holder and medium roll 7 having a friction brake mechanism 8 causing torque and preventing spontaneous unwinding of the medium roll 7, a de-curling roller 9 for removing curl induced in the receiving medium 10 by storage in a rolled up condition.

The print unit 1 itself is provided with:

printer drive rollers 11 and printer pinch rollers 12 which can be lowered onto the receiving medium 10 and which are provided for holding and transporting the receiving medium 10 at a constant speed during printing of the images. Preferably the rollers are provided along the complete width of the apparatus and the drive rollers 11 are driven by a single motor to ensure a constant and even transport of the receiving medium 10 without skew or other irregularities. A possible type of roller for the drive rollers 11 is a metal grid roller while the pinch roller(s) 12 usually have an elastomeric surface at least one (rear) pinch roller 13 to retract and hold the leading edge of the receiving web 10 during printing of the back-side of the image. It working will be described further below.

When operating from a new medium roll 7 the leading part of the receiver medium 10 has to loaded by hand into the print unit 1 where it is caught by lowering the lowered printer pinch rollers 12 which will ensure further transport.

During printing the receiver medium 10 is advanced. Due to the torque caused by the friction brake mechanism 7 acting upon the medium roll 7 a tension is created in the receiving material 10 and curl which remained in the material due to the storage in rolled up state is substantially removed by guiding the material in a relative sharp bend around the decurling roller 9.

It can be understood that also a sheet fed system can be used in conjunction with the print unit 1. However, because sheet feeding systems are usually more complicated and due to the large size of the printed images, it is more convenient to use web feed systems. The loading of the leading edge of the receiving web 10 can be ensured by an automatic system, but usually the loading by hand is the most cost-effective method.

The receiving medium 10 is also guided over a suction plate 14 further holding down the receiving medium 10 at the position of the print head 16 avoiding problems which can be caused by residual curl in the receiving medium 10 after decurling. In the suction plate 14 suction holes 15 are provided while one or more ventilators provide a vacuum in a compartment under the suction plate 14. The receiving medium 10 guided over the suction plate 14 is held to the suction plate 14 by the suction acting upon the receiving medium 10 through the suction holes 5 in the plate.

This ensure a constant distance from the print head 16 to the receiver 10.

The receiver 10 is moved forward by the printer drive rollers 11.

Medium Measuring Sequence

Before printing is commenced, the leading edge and the size of the receiving material 10 is detected using a sensor 17. Preferably this is done by one or more optical sensors using measurement of reflection or transmission. In the described apparatus a single reflection sensor 17, mounted on the shuttle 18 holding the print head 16, is used for detecting the edges of the receiving web 10, but separate systems using one or multiple sensors can be employed. Out of these measurements the size of the receiving medium 10 can be detected and even misalignment can be indicated to the operator.

Printing the Front-side Image

When the medium size is correct and no alignment errors are detected the front-side image is printed by the print head 16. In the described embodiment this is done by a colour inkjet print head 16 mounted on a shuttle 18. As the print head 16 shuttles across the receiving medium 10 the image of the front side is recorded on the receiver 10. In between the different swaths of the print head 16 the medium 10 is moved forward by the printer drive rollers 11 in a controlled manner.

In this way the image is printed gradually. Image data is supplied to the print unit 1 from an image source in a synchronised manner. When using the apparatus for colour/imposition proofing a image containing several pages of a publications are printed on the front side of the receiving medium 10.

While the printer prints the front-side, the leading end of the receiving web 10 gradually enters the tumbler unit 3 located on the front side of the print unit 1.

The Tumbler Unit

Figure 3:
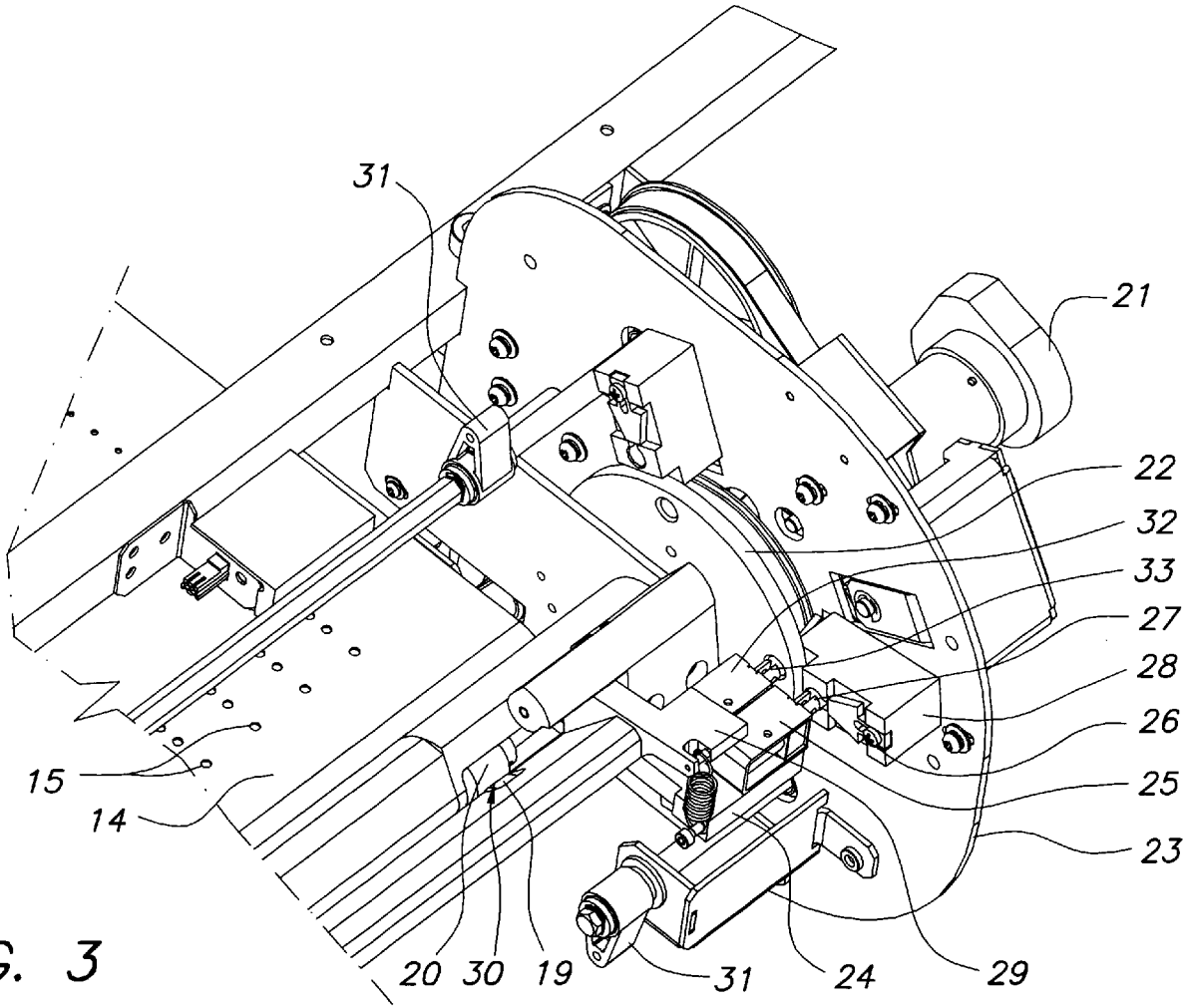

In order to allow further description of the processing steps an elaborate description of the tumbler unit 3 is now given referring to FIGS. 2 and 3:

Within the chassis containing the tumbler mechanism are located:

a central axis carrying at least two forward drive rollers 20.

These forward drive rollers 20 are driven by separate driving mechanisms 21 allowing them to be driven independently, i.e. rotate at different speed and/or direction. For normal feed through they are driven in a synchronised manner in order to ensure a straight feeding of the receiver sheet 10.

At least one end the drive roller axis a driver disc 22 is provided coupled to the axis. This driver disc 22 is able to freely rotate within the chassis 23 of the tumbler unit. Its function will be explained later.

a rotatable platform 24 which can be locked by a position locking mechanism 25 to the chassis 23 at various fixed positions (A, B, C) relative to the tumbler chassis 23. This can be done in various ways making use of e.g. Pins, brakes, cams, etc. A reliable and cost-effective method is the use of an electromagnetic movable locking pin 26 which can be extended from the rotatable platform 24 into a hole 27 in the chassis 23 of the tumbler unit 3. To provide easy manufacture the hole 27 may also be provided in a position block 28 which is coupled to the chassis 23.

The rotatable platform 24 mainly carries:

forward pinch rollers 19 and pinch roller lowering mechanism 29.

In conjunction with each drive roller 20 a corresponding pinch roller 20 is provided. By using the mechanism 29, the pinch rollers 20 can be lowered or raised in order to close or open the nip 30 between the drive and pinch rollers 19, 20. The mechanism 29 to raise and lower the pinch rollers 19 can be driven by an electrical motor but various other systems can be used. E.g. cam mechanisms, air pressure, etc. In the preferred embodiment the lowering mechanism 29 is driven by using cams 31 coupled to the tumbler chassis 23. Preferably a pinch roller locking mechanism is provided in order to lock the pinch rollers 20 in a closed state. This locking can be done in various ways. A simple and cheap method is making use of a mechanical locking mechanism.

The rotation axis of this rotatable platform 24 preferably coincides with the axis of the drive rollers 20 and the driver disc 22. Thereby only the position of the rotatable platform 24 changes during its rotation while the distance of the rotatable platform to the driver rollers 20 is constant. This ensures that the forward pinch rollers 19 remain in contact or at a constant distance with the corresponding drive rollers 20 during rotation of the rotatable platform 24. Herewith only the orientation of the nip 30 will change during rotation of the rotatable platform 24.

A second locking mechanism, the driver disc locking mechanism 32, which is also preferably a locking pin 33 which can be extended electromagnetically, provided on the rotatable platform 24 enables the rotatable platform 24 to be coupled to the driver disc 22. Instead of mounting the various locking mechanisms 25, 32 onto the rotatable platform 24, it is possible to provide locking mechanisms on the tumbler chassis 23 and/or driver disc 22 to ensure locking of the rotatable platform 24 at the various locations A, B, C and the driver disc 22.

Feed-forward and Locking Action

Figure 4:
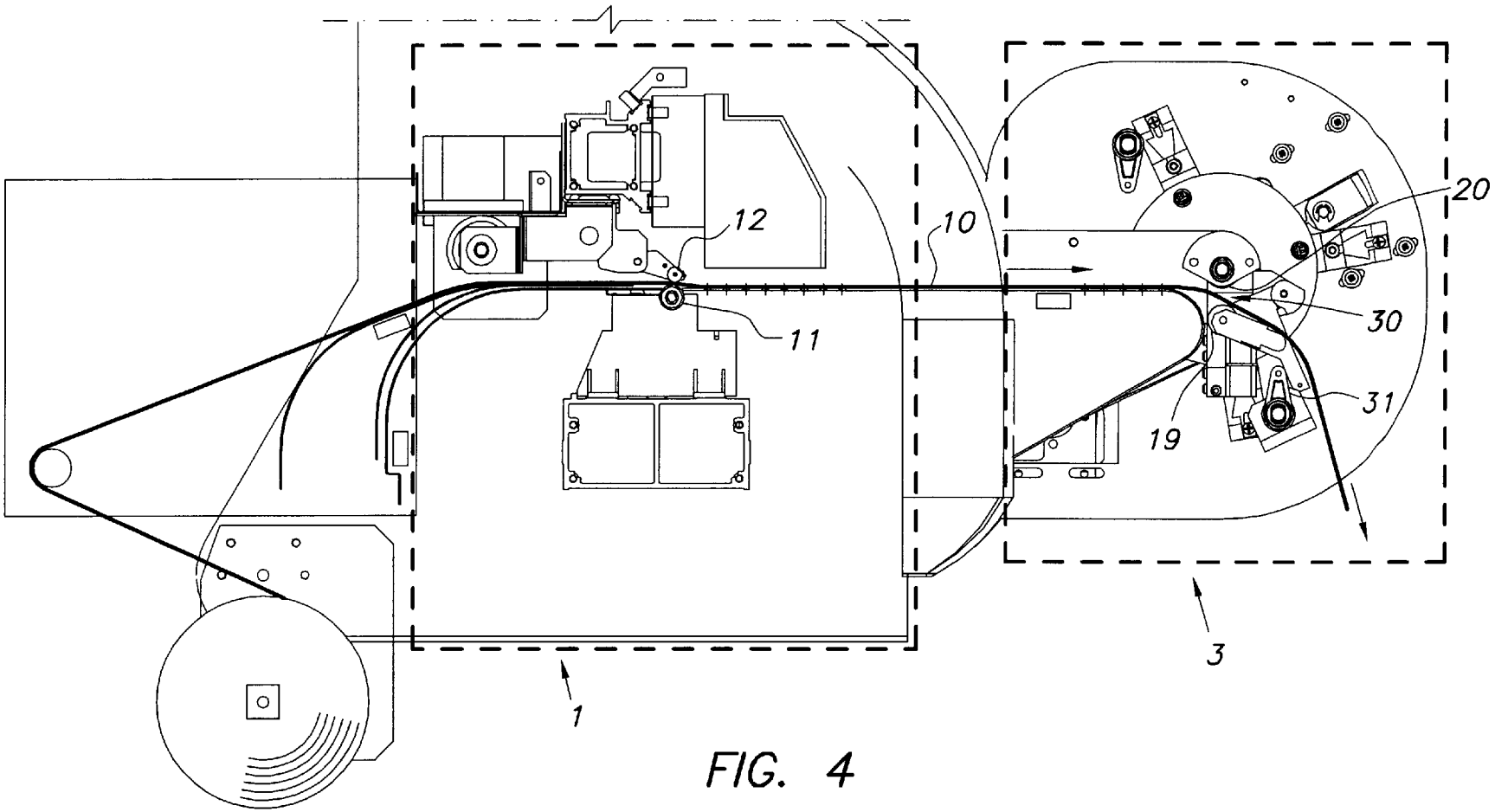
FIG. 4 shows the feeding of the web during front-side printing

As shown in FIG. 4 the nip 30 between the front drive rollers 20 and corresponding front pinch rollers 19 is initially opened in order to freely let the leading end of the receiving medium 10 pass through the tumbler unit 3.

This ensures that the transport speed of the print unit 1 is not influenced and the printed image is undisturbed.

When the front-side image is completely printed the receiving web 10 is fed to the required position to enable it to be cut of at the correct place. The printer driver rollers 11 stop and hold the receiver web 10.

Figure 5:
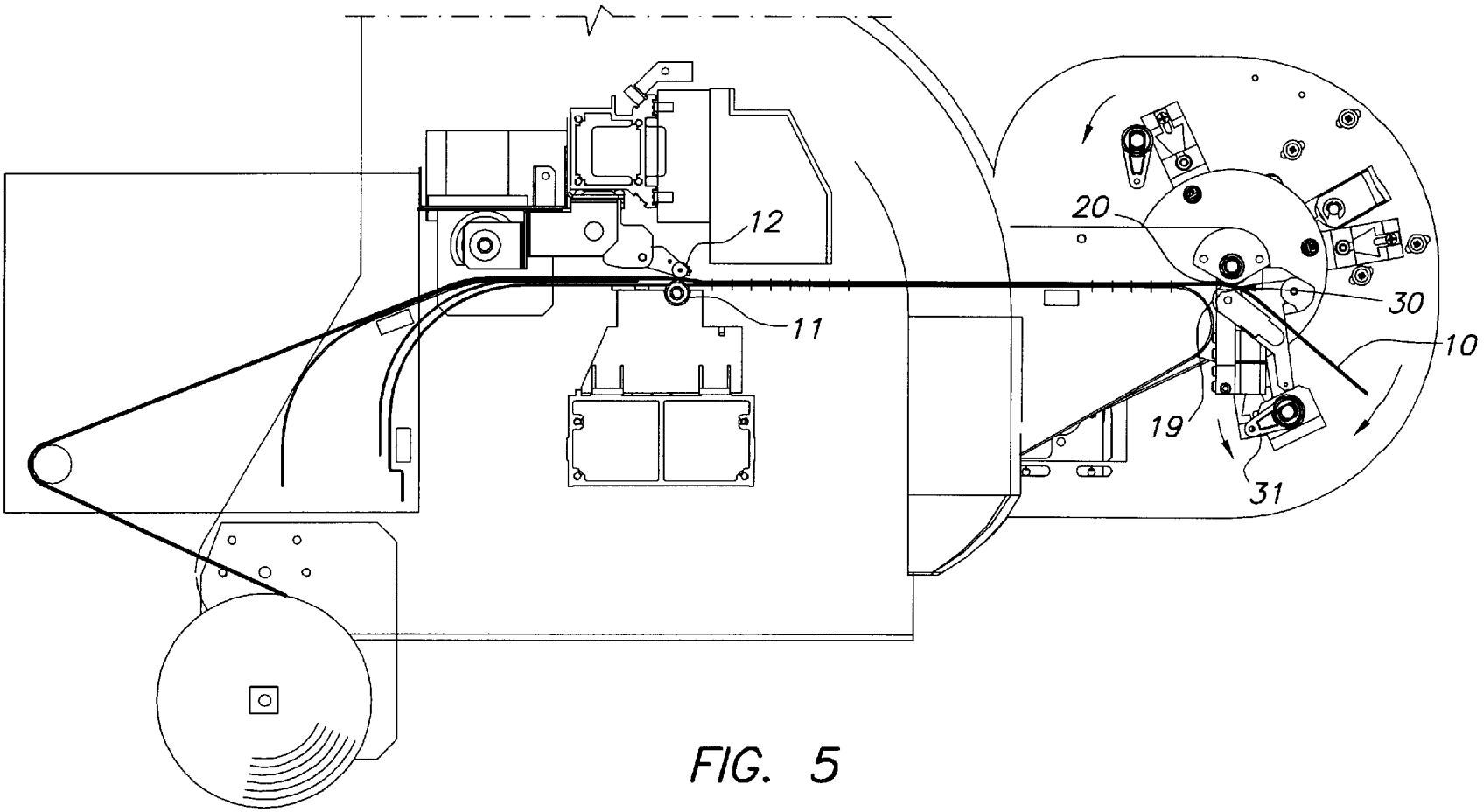
FIG. 5 shows the position after the gripping of the web by the tumbler unit.

By rotating the cam 31 provided on the tumbler chassis 23 the lowering mechanism 29 on the rotatable platform 24 is released and the forward pinch rollers 20 are lowered closing the nip 30 between the front drive and front pinch rollers 19, 20 and the receiving web 10 is thus held by the front drive and pinch rollers 19, 20 at the side of the printed image and by the printer drive and pinch rollers 11, 12 at the non-printed part as shown in FIG. 5.

Cutting Action

A cutting mechanism now cuts the receiving web 10 at the appropriate location separating the printed image from the non-printed part of the receiving web 10 thus creating a receiver sheet carrying a printed image on the front side.

Several possible cutting mechanisms can be used. Preferable the cutting can be done using a knife blade mechanism mounted on the shuttle 17 of the print head 16 which can be actuated when necessary.

After the cutting the front pinch/drive rollers 19, 20 now have control over the receiver sheet.

Web Retraction Step

Figure 6:
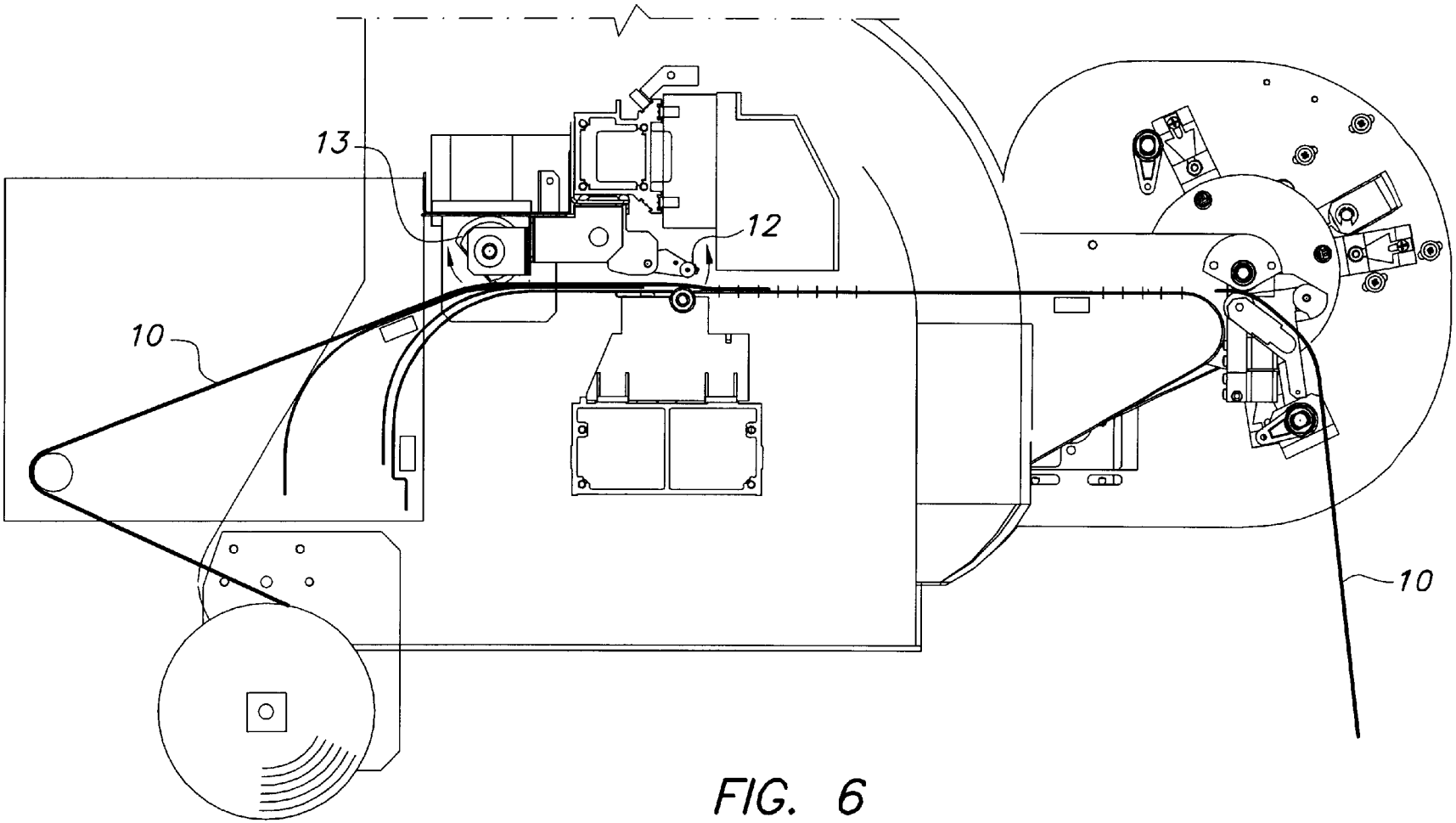
FIG. 6 shows the contacting of the web by the rear pinch roller

After the printed image is separated from the rest of the web the rear pinch roller 13 contacts the web. This can be done by a lowering mechanism, but as indicated in FIG. 6 an embodiment is possible wherein a partial roller contacts the web 10 simply by rotation of the partial pinch roller 13. The dimensions of the rear pinch roller 13 may be so that it spans the whole width of the printer or it may be divided into two or more pinch rollers 13 dispersed over the printer width. Preferably the web 10 has to be contacted at at least two points relatively far apart to ensure that the web 10 is prevented from rotating to a slant position.

After the rear pinch roller 13 contacts the web 10, the printer pinch rollers 12 are lifted so that the control of the web 10 is given to the rear pinch roller 13 which prevents the medium 10 from dropping out of the print unit 1.

Figure 7:
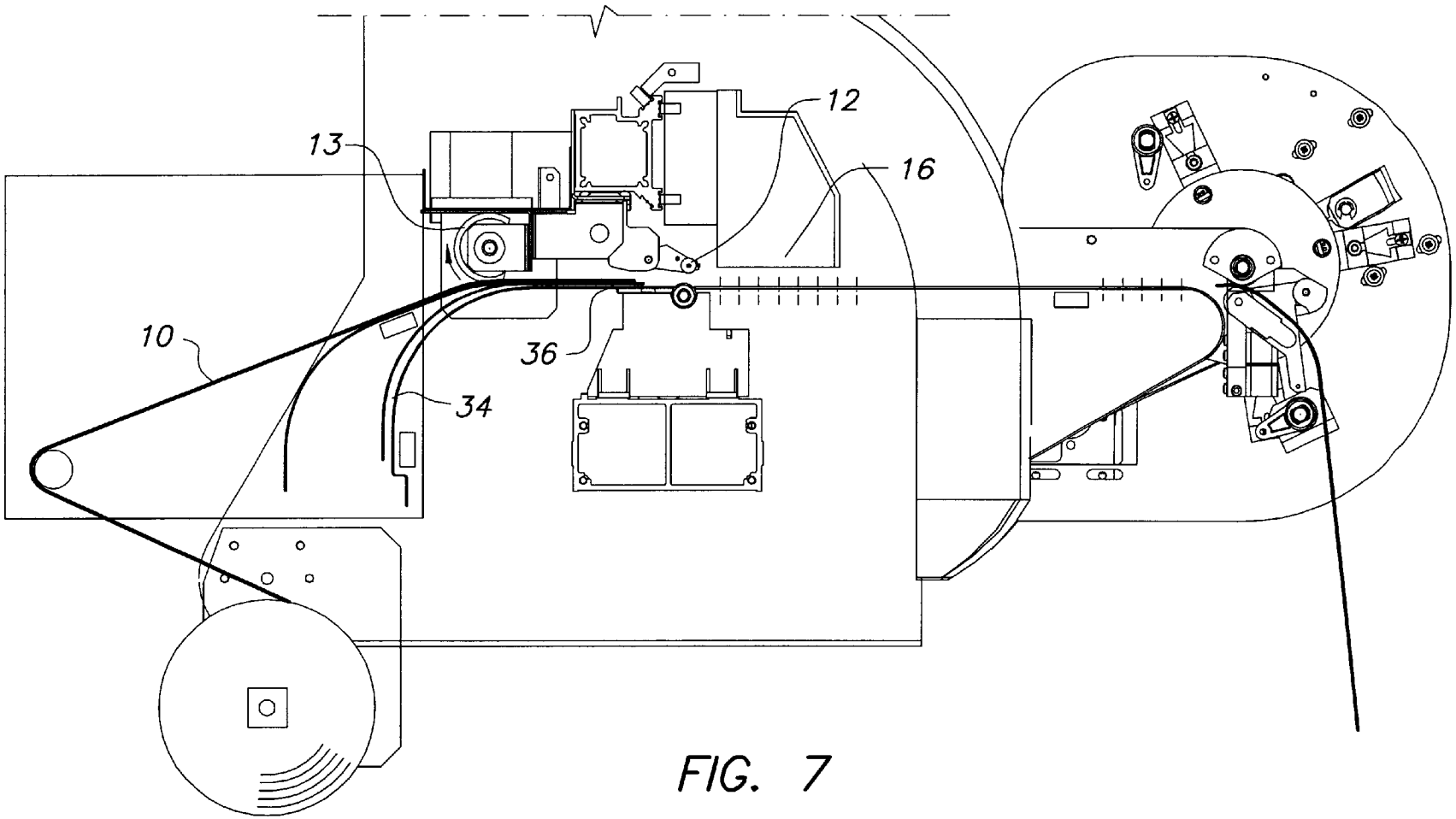
FIG. 7 shows the print unit with the web in a retracted position

As shown in FIG. 7, by rotating the rear pinch roller 13 backwards the leading end of the web 10 is retracted behind the position of the print head 16 and the position of the printer pinch rollers 12. Retraction is stopped when the entrance slit 36 of the re-feeding storage chamber 34 is cleared. The leading end of the web 10 is kept stationary until the printing of the next front-side image. Depending upon the dimensions of the printer and the rear pinch roller 13 itself, the number of rotations of the rear pinch roller 13 may vary. A small diameter of the roller 13 may require several rotations to retract the leading end of the web 10. In case of a partial roller, as shown in FIGS. 6 and 7, the dimensions need to be chosen so that only a partial rotation is necessary to perform retraction.

The retraction and holding of the receiving web 10 by the rear pinch roller 13 during further printing of the backside image allows also to automatically load the receiving web 10 to the printing unit. This will be explained later.

Handling of the Cut-sheet Carrying the One-sided Image

Feeding the Receiver out of the Printer into the Tumbler Unit

Figure 8:
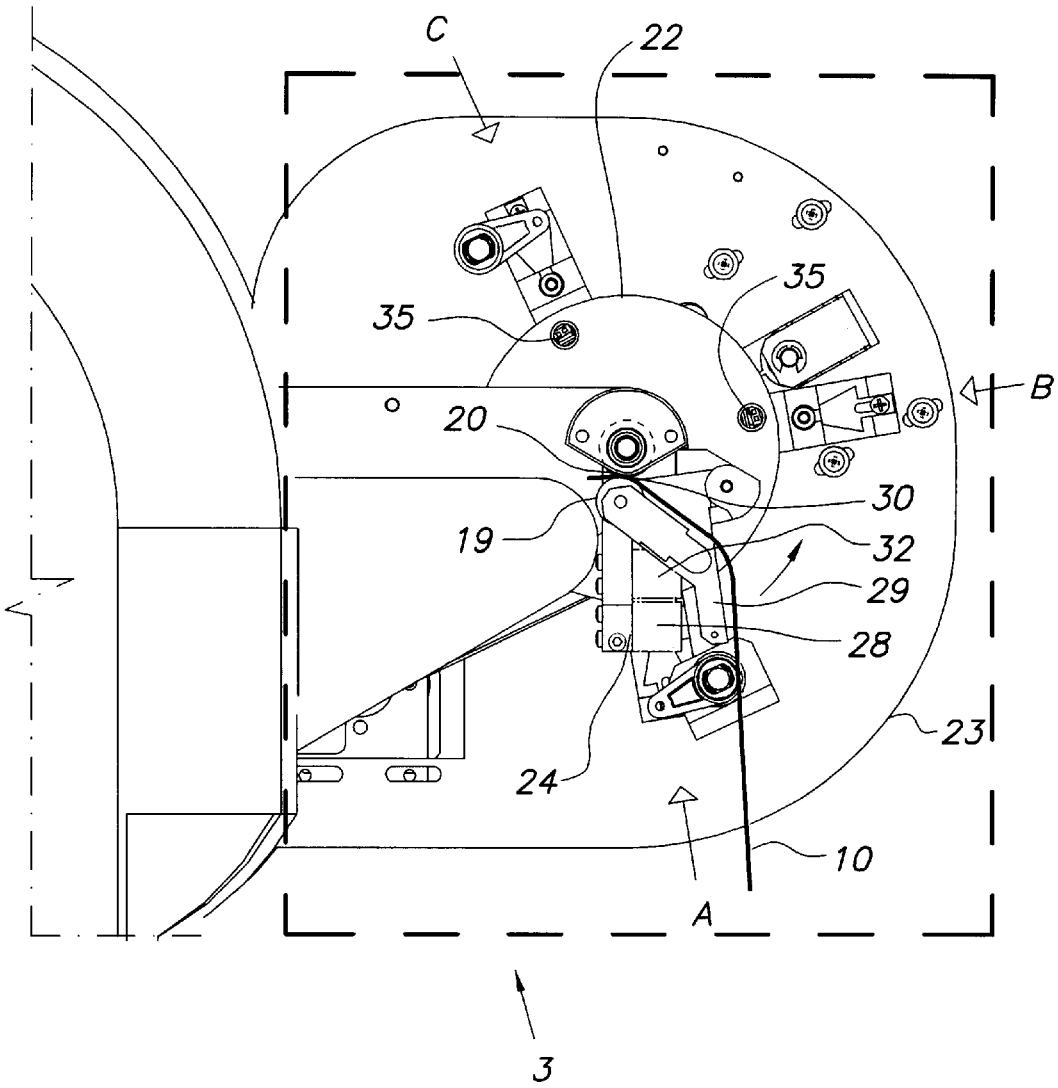
FIG. 8 shows the tumbler unit with sheet position before rotating the rotatable platform to the feed-through position B

The receiving sheet 10 cut from the web, carrying the front side image, is fed forward into and trough the tumbler unit 3 by rotation of the front-drive rollers 19, coupled to the drive disc 22, until the rear end of the receiving sheet 10 has cleared the printer unit 1 resulting in the situation of FIG. 8. The front end drive rollers 20 are stopped and tumbling action is started.

Now the tumbler sequence as can be used in the double-sided printer is described.

Rotation to Feed-Trough Position.

In al previous actions the rotatable platform 24 is fixed by the position locking pin 26 in the initial position A as shown in FIG. 8. The only action taken by the tumbler unit 3 was the closing of the nip 30 for taking hold of the receiving sheet 10. As the receiving sheet 10 carrying the front side image has cleared the print unit 1 and the front end drive rollers 20 and the coupled driver disc 22 are stopped, the tumbling action is started. When stopping the driver disc 22, it is positioned so that a hole 35 in the side of the driver disc 22 exactly is in line with the driver disc locking mechanism 32 of the rotatable platform 24. The driver disc locking pin 33 of the driver disc locking mechanism 32 is electromagnetically extended into the hole 35 in the driver disc 22. The pin 26 of the position locking mechanism 25 is retracted so that the rotatable platform 24 is now only coupled to the driver disc 22.

By slowly turning the forward drive rollers 20 and driver disc 22 the rotatable platform 24 is now rotated to the feed-through position B. While the drive rollers 20 rotate, the pinch roller lowering mechanism 29 and pinch rollers 19 mounted on the rotatable platform 24, make a circular movement around the drive rollers 20 at the same axial speed as the drive rollers 20. This results in the change of the orientation of the nip 30 between drive and pinch rollers 19, 20 which is holding the end of the receiving sheet 10. When arriving at position B, illustrated in FIG. 9, the rotation is stopped and the position locking mechanism 25 locks the position of the rotatable platform 24 relative to the tumbler chassis 23 by extending the position locking pin 26 into a hole 27 in a position block 28 mounted on the chassis 23. Afterwards the driver disc locking mechanism 32 is disengaged by retracting the pin 33.

The last printed end of the printed image is now facing downwards with the printed side towards the print unit 1.

Feed-Through Step.

Figure 9:
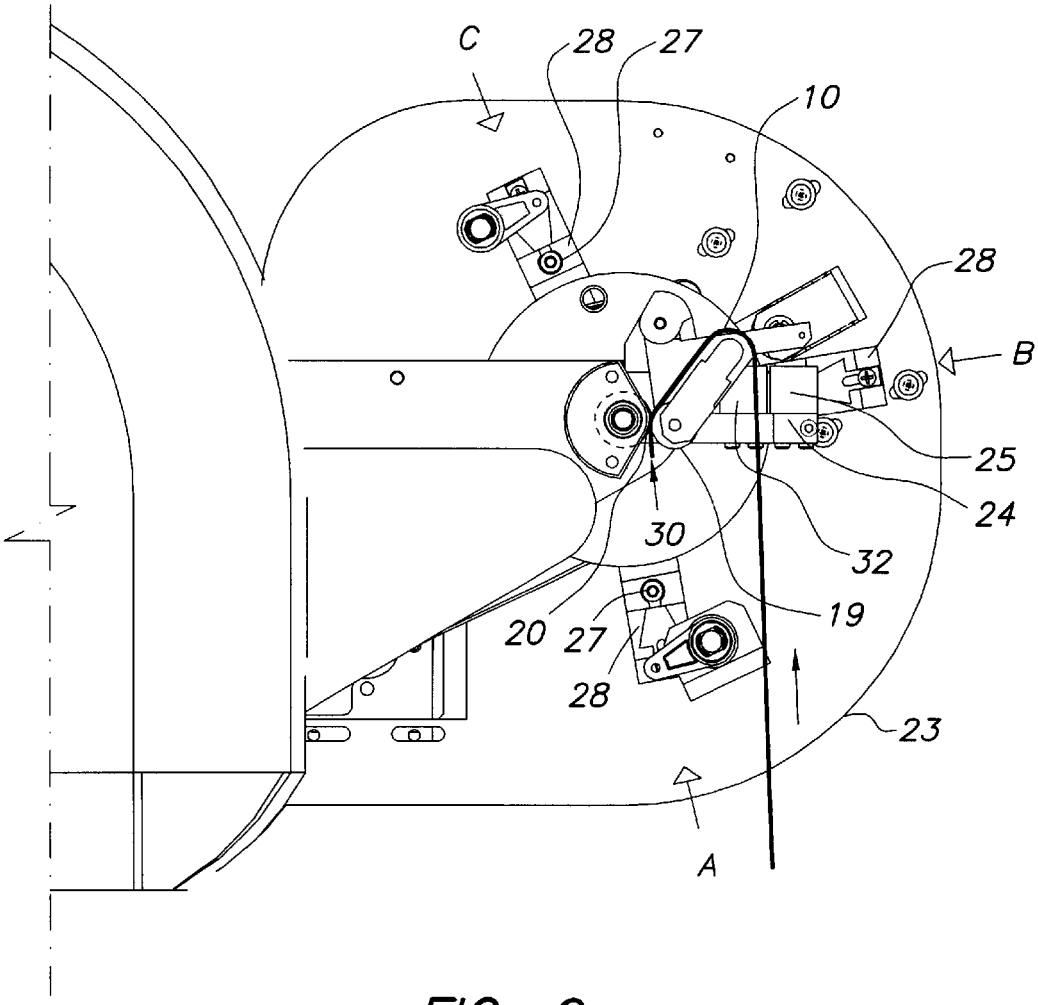
FIG. 9 shows the feed through action of the receiving sheet
Figure 10:
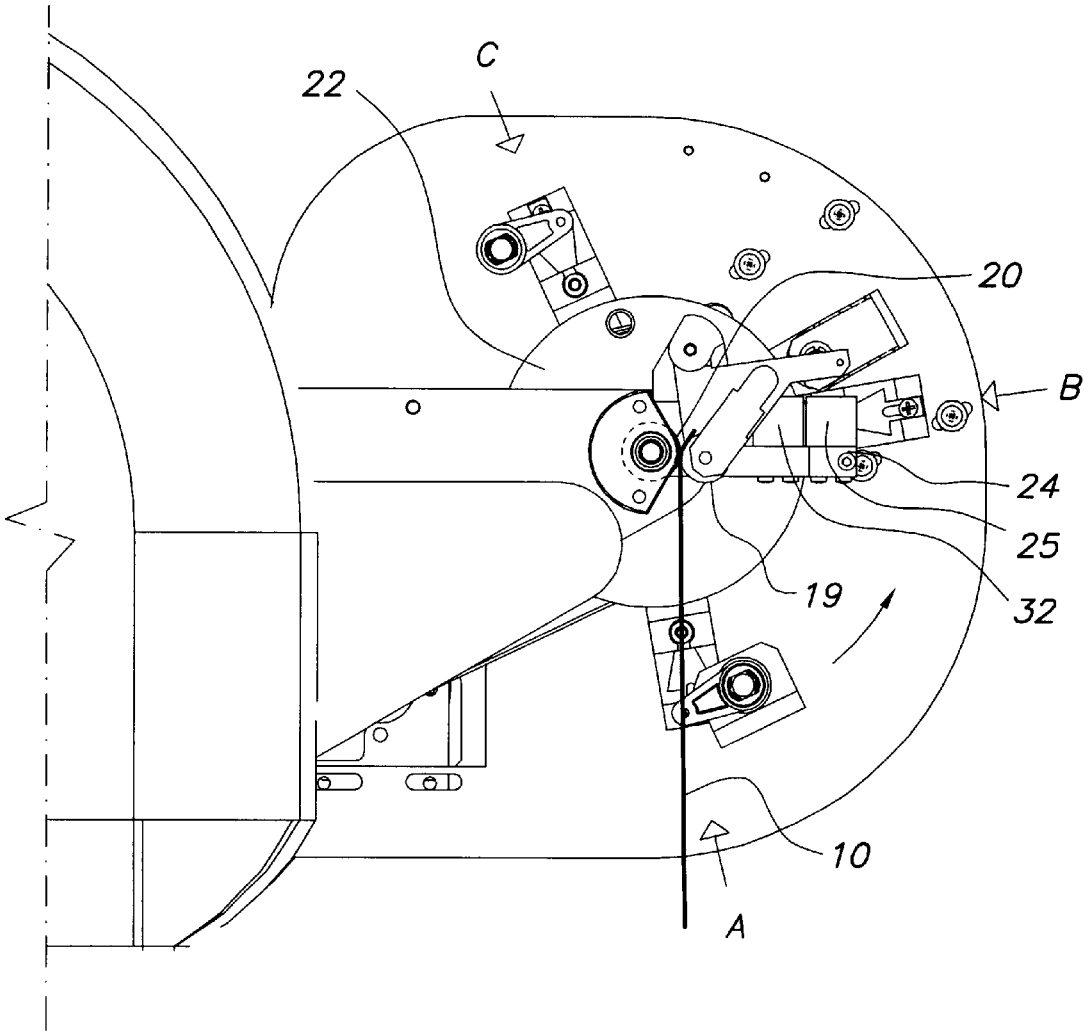
FIG. 10 shows the tumbler unit with sheet position before rotating the rotatable platform to the re-feed position C

As shown in FIG. 9 the forward drive rollers 20 now perform a feed-trough operation, lowering the last printed end of receiving sheet 10 carrying the printed image and raising the starting end of the printed image. The feed-through operation is stopped by stopping the rotation of the drive rollers 20 and the coupled drive disc 22 as the beginning of the receiving sheet 10 enters the tumbler mechanism. As shown in FIG. 10 the receiving sheet 10 is now in position to allow rotation of the rotatable platform 24 to the re-feeding position indicated by C.

Rotation to the Re-Feeding Position.

Figure 11:
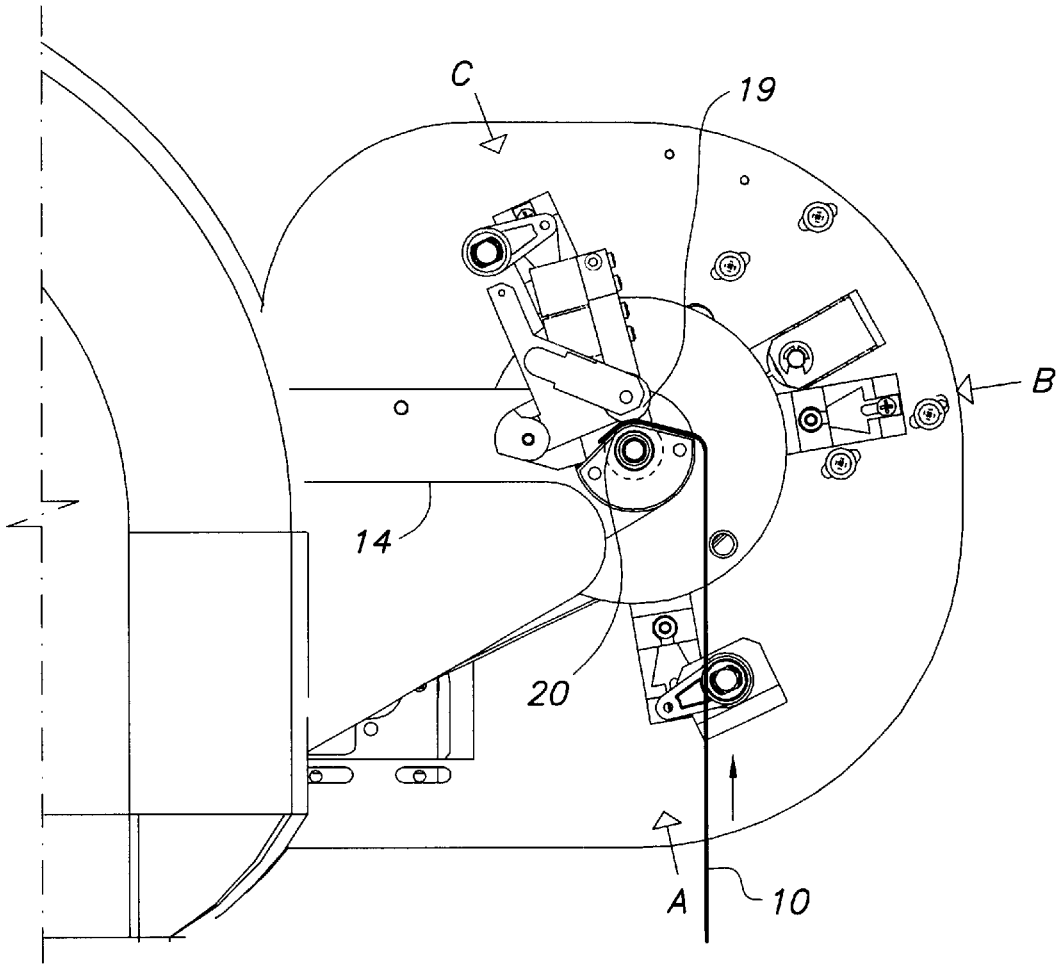
FIG. 11 shows the re-feed transport at position C

The drive disc 22 and coupled drive rollers 20 are halted so that a hole 35 in the drive disc 22 is aligned with the pin 33 of the drive disc locking mechanism 32 on the rotatable platform 24. The rotatable platform 24 is now coupled to the driving disc 22 by extending the pin 33 of the driver disc locking mechanism 32. Afterwards the position locking mechanism 25 is disengaged from the chassis 23 and by slowly rotating the driver disc 22 and driver rollers 20 the rotatable platform 24 is rotated to position C where it is stopped and locked again by the position locking mechanism 25 after which the driver disc locking mechanism 32 is released. The beginning of the receiving sheet 10 is now pointing to the print unit 1 with the printed image facing down as shown in FIG. 11

Re-Feeding Step

The receiving sheet 10 carrying the image is now re-fed to the print unit. This is indicated in FIG. 11.

This is done by rotation of the (two) front drive rollers 20 of the tumbler unit 3.

Because of the weight and the size of the receiving sheet 10 problems may arise when the receiving sheet 10 is simply re-fed to the print unit 1 in one single movement.

Due to the weight and size of the receiving sheet 10 hanging down from the tumbler unit 3, elasticity of the coating of front drive rollers 20 and/or front pinch rollers 19 and the fact that the receiving sheet 10 is only driven at two drive rollers 20 while there is a drag force acting on the receiving sheet 10 in between the drive rollers 20 there is a likelihood of developing buckling phenomena. A known drag force is the suction action of the suction plate 14 pulling the receiver sheet 10 to the suction plate 14. This results in an unevenness of the re-fed receiving sheet 10 which can result in paper jams or other problems such as paper deformation etc . . . The build-up of the buckle grows gradually during re-feeding of the receiving sheet 10. The developed buckle can however be removed easily by reversing the feeding direction of the drive rollers 20 for a short while. Thus the buckle builds up during a relative long re-feeding action and is removed by shortly reversing the transport direction of the front drive rollers 20. In an alternative method the rollers are merely halted without reversing the transport direction of the sheet. This transport in a stepwise manner is repeated until the receiving sheet 10 can be re-fed to the print unit 1 without further buckling. This will mostly be possible when the receiving sheet 10 is partially re-fed to the print unit 1 and the weight of the receiving sheet 10 hanging down from the tumbler unit 3 is relatively low. The receiving sheet 10 is re-fed into the print unit 1 with the front end into the entrance slit 36 of the re-feeding storage chamber 34 till it is in position illustrated in position of FIG. 12, ready for the following step.

Alignment Procedure

In order to obtain a good registration of the images on the front and back side of the receiving sheet 10 an alignment procedure is necessary. This is done by an alignment system.

Figure 12:
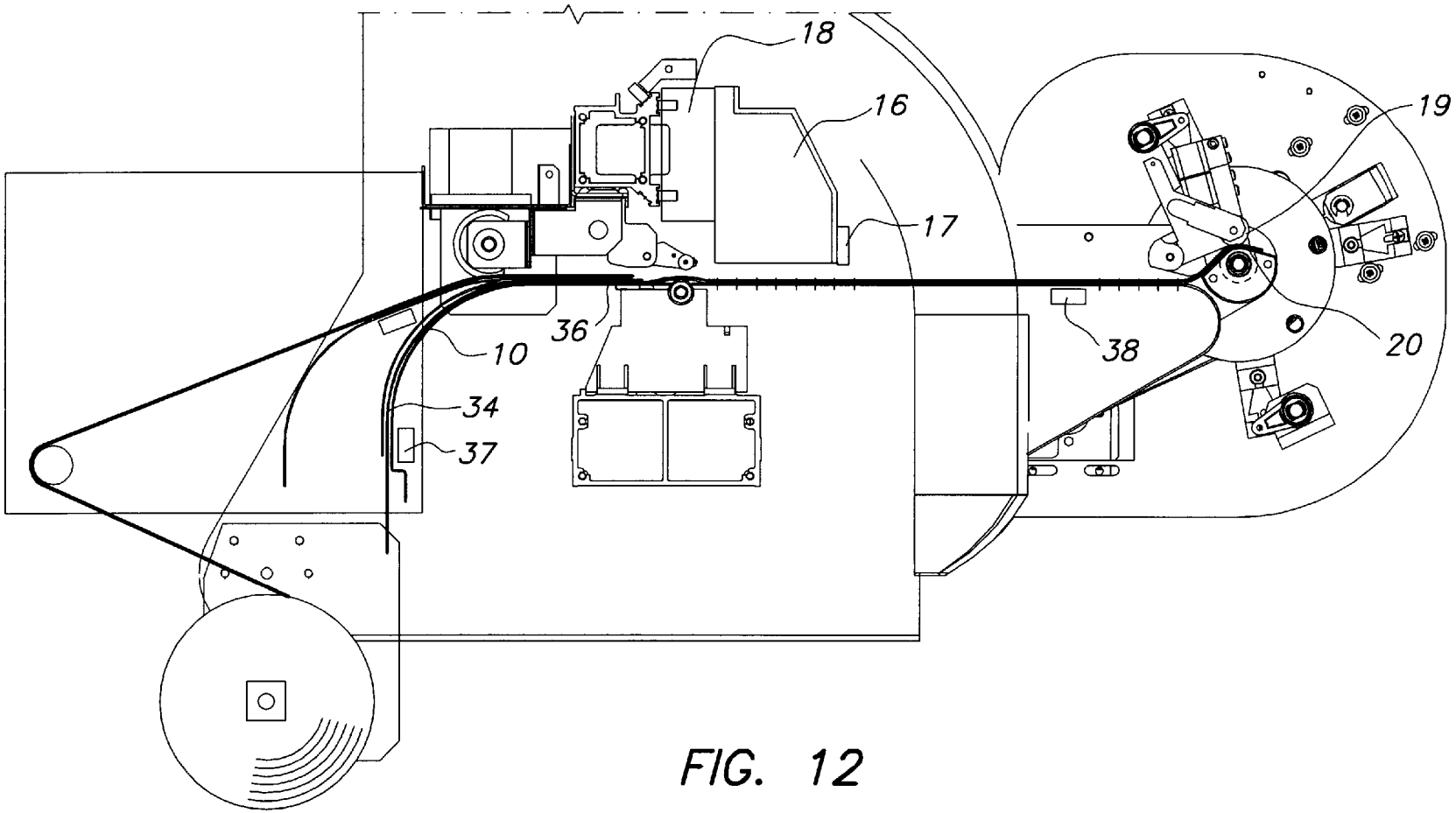
FIG. 12 shows the paper path entering the re-feeding storage chamber.

The receiving sheet 10 is re-fed into the print unit 1 until it can be sensed by alignment sensors 37 and 38 indicated in FIG. 12. These alignment sensors 37, 38 are able to determining the position of the edge of the receiving sheet 10, and thus the position of the receiving sheet 10 which has been re-fed. By sensing the edge of the receiving sheet 10 at at least two locations the overall position of the receiving sheet 10 can be derived. To enhance the accuracy of the determination by the alignment sensors 37, 38 these two locations preferably are located near the beginning and starting end of the receiver sheet 10. Another method is detection of the edge by one sensor which is used at two different positions or alternatively by detecting the edge of the receiving sheet 10 by using a single sensor at one location before and after the receiving sheet 10 is fed-trough for a predetermined distance. This measuring can e.g. be done by the measuring sensor 17 mounted on the shuttle 18 carrying the print head 16. Another possibility is the measuring by one sensor which itself is moved to measure the edge position at least two different locations.

Even a sensor directly sensing the orientation of the sheet can be conceived.

The sensing is preferably done by a non-contact sensor, e.g. an optical sensor which is able to detect the edge of the receiving sheet by detection or transmission or reflection.

Parameters which e.g. can be derived by a processing circuit are:

Slantness of the re-fed receiving sheet 10.

Overall position of the receiving sheet 10 relative to the middle of the print unit 1.

Figure 13:
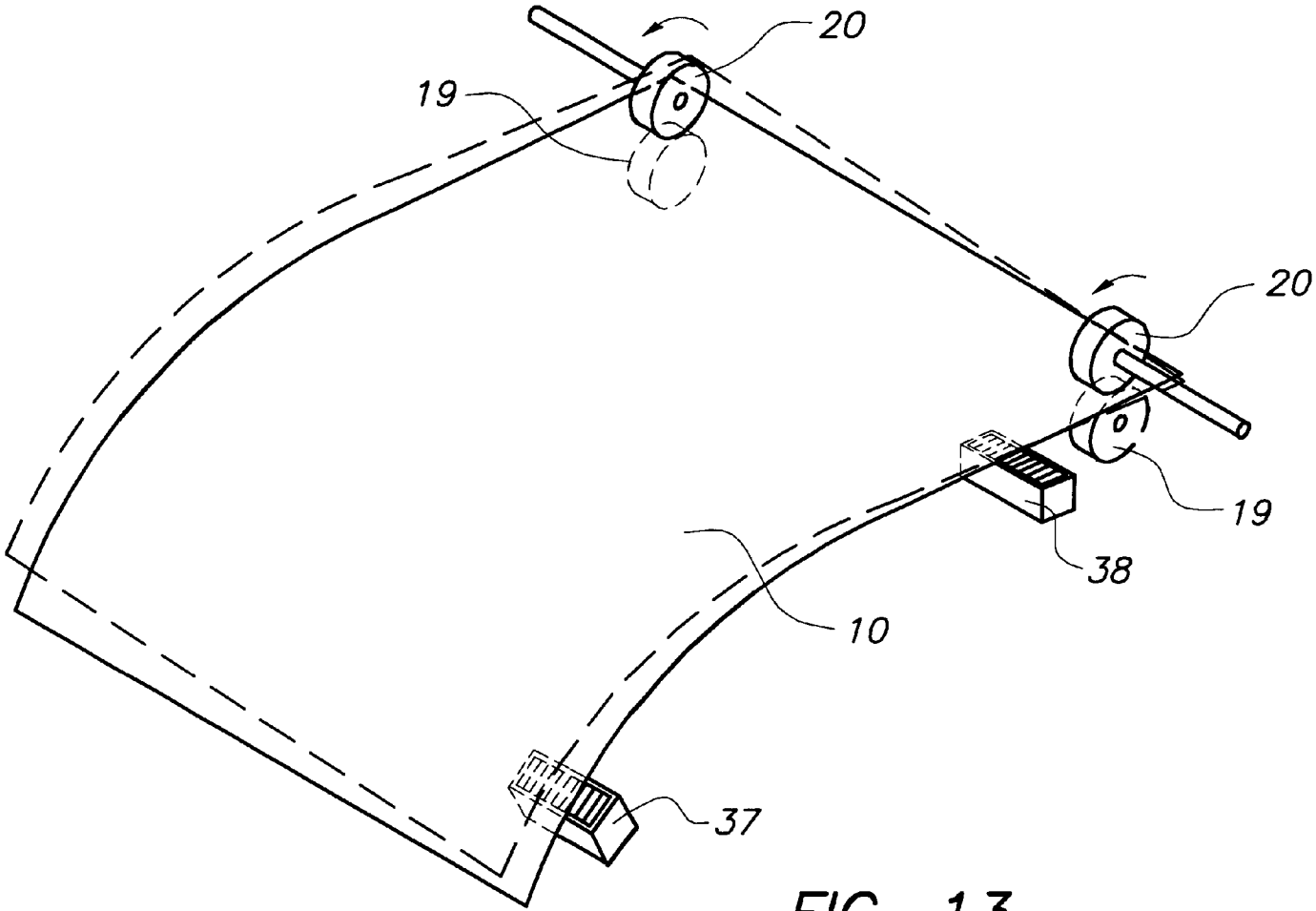
FIG. 13 shows the principle of correcting the receiving sheet orientation using drive rollers with different speed.

This orientation and position can be corrected alignment correction system. This is done by driving the forward drive rollers 20 of the tumbler unit 3 with different speed or direction. Due to the fact that the drive rollers 20 have separate driving mechanisms 21, it is not difficult to perform a differential driving of the driving rollers 20. The principle is illustrated in FIG. 13. As one side of the receiving sheet 10 is driven by a drive roller 20 with a certain speed and the other side is held still or is driven by another drive roller 20 with an appropriate different speed and/or direction. Thus the receiving sheet 10 is forced to make a rotational movement which can bring the receiving sheet 10 in a desired orientation.

To perform a lateral displacement parallel with the edge of the receiving sheet 10, one can rotate it slightly by use of driving the forward drive rollers 20 with different speed to obtain a slant orientation, feed the receiving sheet 10 through for a predetermined distance and rotating it back by differential driving of the drive rollers 20 to the required orientation.

It is preferred that after each adjustment of the orientation the receiving sheet 10 is fed back and forth for a short distance to remove buckle which can develop by rotation of the receiving sheet 10 at the drive rollers 20 and the drag exerted on the receiving sheet 10 in the print unit 1.

Rotation speed and rotation direction of each forward driving rollers 20 is determined by the processing unit based upon derived parameters and desired position.

After each position adjustment, the position of the receiving sheet 10 can be redetected and evaluated by the alignment sensors. As it can be understood, preferably the drive and pinch rollers 19, 20 of the tumbler unit are used. But it is also possible to provide separate drive and pinch rollers to align the receiving medium 10. These separate alignment system can be located in different sections of the apparatus.

Previously described is an alignment procedure correcting the position of the receiving sheet 10.

Another way to adapt to the detected displacement of the receiving sheet 10 is by printing the image on the back side at an adjusted location. This can be done in an electronic way by adjusting the data to be printed so that they are printed at another location. Also a mechanical adjustment of the shuttle 17 of the print head 16 or of the print head 16 within the shuttle 17 are possible solutions for adjusting to a displacement of the receiving sheet 10.

Re-Feeding into the Storage Chamber by the Printer

After ensuring proper alignment of the receiving sheet 10 the print pinch rollers 12 are lowered in order to take control over the receiving sheet 10 during printing of the back side. The nip 30 in the tumbler unit 3 is opened by unlocking lifting the front pinch rollers 19 by use of the cam 31 at position C acting upon the pinch roller locking and lowering mechanism 29.

Figure 14:
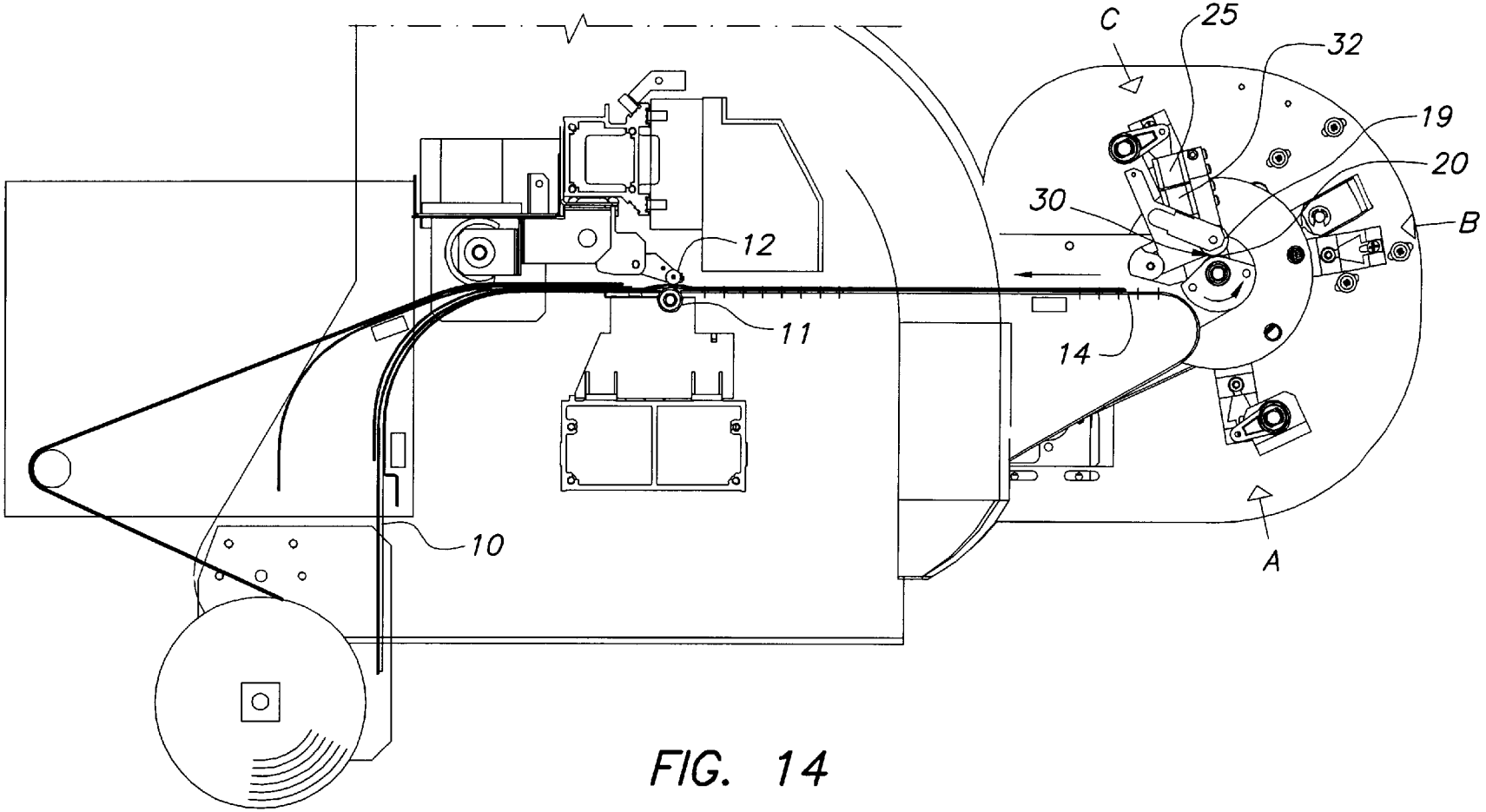
FIG. 14 shows the situation with the receiver sheet entering the storage chamber under control of the printer drive rollers and tumbler unit in position C.

The printer drive and pinch rollers 11, 12 feed the receiving sheet 10 backwards into the re-feeding storage chamber 34 until the edge of the receiving sheet clears the forward drive and pinch rollers 19, 20 as shown in FIG. 14.

Reset of the Tumbler Unit.

As the receiving sheet 10 has cleared the tumbler unit 3, the drive disc 22 and drive rollers 20 are stopped at an appropriate location in order to allow the drive disc locking mechanism 32 to lock the disc drive locking pin 33 into the drive disc 22.

The position locking pin 26 of the position locking mechanism 25 is retracted from the tumbler chassis 23 or position block 28 and the rotatable platform 24 is repositioned at the initial position A where it is locked relatively to the chassis 23 by the position locking mechanism 25 and the driver disc 22 is released by the driver disc locking mechanism 32.

The tumbler unit 3 is now in the initial position A with the nip 30 between drive and pinch rollers 19, 20 opened in order to let the receiving sheet 10 pass during the printing of the back side. The tumbler unit 3 remains in the same position till a next sheet is to be cut off.

Printing of the Back-Side Image

Figure 15:
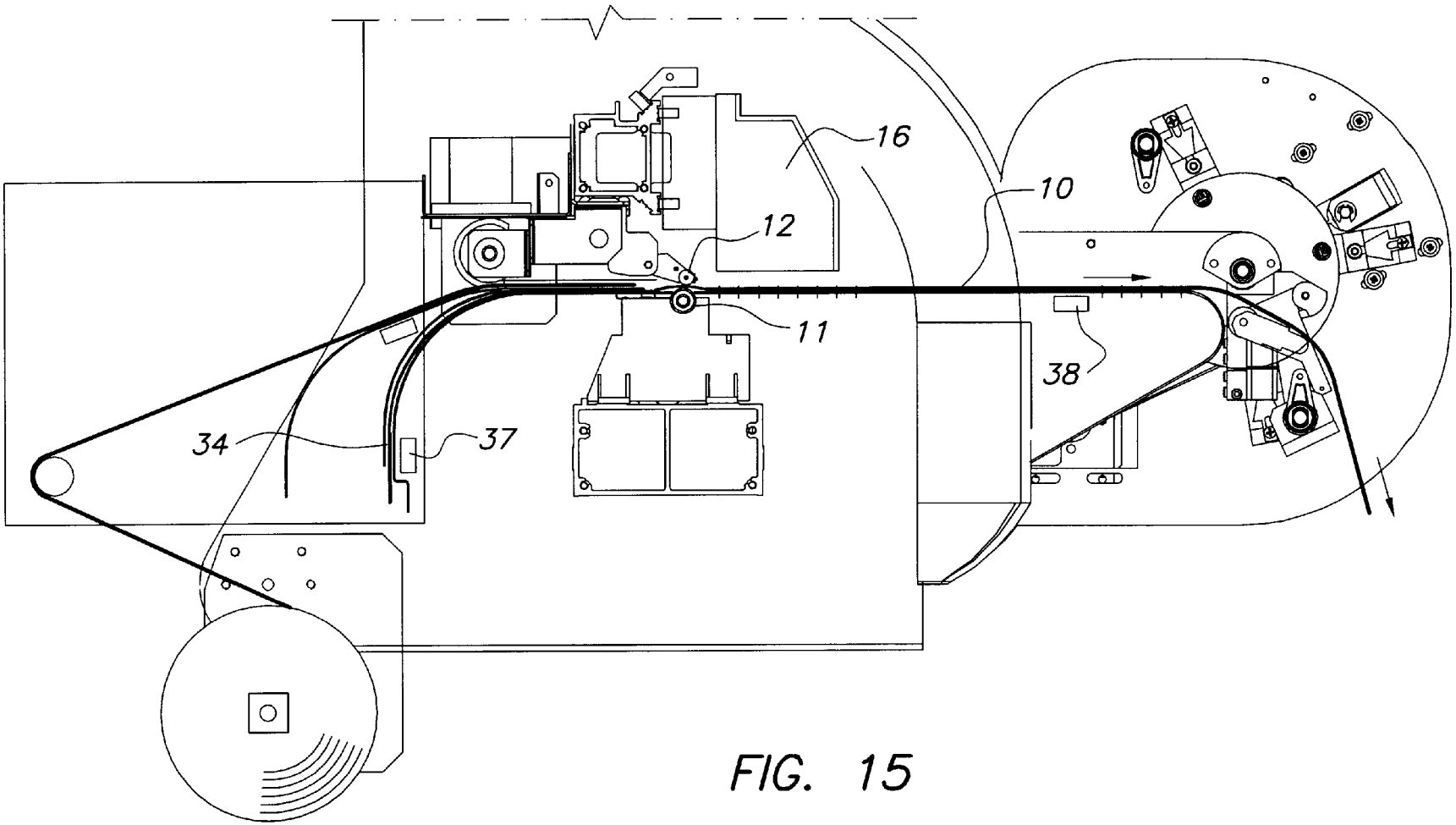
FIG. 15 shows the printing of the back-side image with the receiver sheet fed from the re-feeding storage chamber.

The receiving sheet 10 is now stored in the storage chamber 34 with the front side image downwards while the start of the receiving sheet 10 is held between the printer drive and pinch rollers 11, 12. A second printing step is now performed on the backside of the receiving sheet 10. This is illustrated in FIG. 15

Before printing on the backside is started, the leading edge and the size of the receiving material 10 is detected, in the same way as before printing of the front side, after which the backside image is recorded. As the print head 16 shuttles across the receiving medium 10 the image of the back side is recorded on the receiver 10 while the printer transport and pinch rollers 11, 12 ensure correct feeding of the receiving sheet 10. Image data is supplied to the print unit 1 from an image source in a synchronised manner and in relation to the orientation of the front side.

When using the apparatus for colour/imposition proofing an image containing several pages of a publication are printed on the back side of the receiver 10.

While the print unit 1 prints the back-side, the leading end of the receiving sheet 10 gradually enters the tumbler unit 3 located on the front side of the printing apparatus. As the print is completed the receiving sheet 10 is released by the printer pinch rollers 12 and it is dropped in a receiving basket 6 mounted on the pedestal of the printer.

Reloading of the Web

After completing the whole print cycle, the receiving web 10 which was gripped and retracted by the rear pinch roller 13 can be reloaded into the printing unit 1.

The printer pinch rollers 12 are lifted.

As the rear pinch roller 13 is rotated forward the end of the receiving web that was gripped by the rear pinch roller 13 will enter the nip between the printer drive rollers 11 and the printer pinch rollers 12. The web is then gripped by the printer pinch rollers 12. By further rotating the rear pinch roller 13 the receiving web is released by the rear pinch roller 13. As explained above a separate lowering mechanism can be provided for the rear pinch roller 13.

The receiving web 10 is now in control of the printer drive rollers 11 and printer pinch rollers 12.

The possibility of retracting and holding the receiving web 10 and afterwards reloading the web by a rear pinch roller in conjunction with the printer rollers 11, 12 enables an automatic continuous operation of the apparatus without operator intervention.

Having described in detail preferred embodiments of the current invention, it will now be apparent to those skilled in the art that numerous modifications can be made therein without departing from the scope of the invention as defined in the appending claims.

In the preferred embodiment the front pinch rollers 19 mounted on the rotatable platform rotate around the front drive rollers 20 when the tumbler unit is rotated. The front pinch rollers 19 and the receiving web 10 are situated under the front drive rollers 20 during feeding of the receiving web 10 to the tumbler unit 3. During the re-feeding action the front pinch rollers 19 and receiving sheet 10 are situated above the front drive rollers 20.

In other embodiments it is possible that the action is reversed and the front pinch rollers 19 move from the upper to the lower side of the front drive rollers 20. Feed trough direction may vary in specific embodiments during tumbling action.

In other embodiments it is possible that both rollers 19, 20 are located on a revolving platform 24 which has a rotation axis falling substantially on the centre-line of the nip 30. During rotation of the tumbler unit 3, the height of the receiving sheet 10 in relation to the printing engine 1 will stay the same.

In another possible embodiment the drive rollers 20 rotate around the front pinch rollers 19 during rotation of the rotatable platform 24.

It can also be understood that in other embodiments the front pinch rollers 19 are also driven or a lowering mechanism 29 can also be provided for the front drive rollers 20.

Having described different steps during image formation, it can be understood certain steps need not to be performed in the exact order as described. Especially the alignment procedure can be executed at nearly every stage of the printing cycle. I.e. alignment can be performed at any stage as long as the forward drive/pinch rollers 19, 20 take control over the receiving sheet or web 10 and edge sensing can be performed.

The paper sheet 10 can be cut off before any image is recorded on it. the receiving sheet 10 could be store twice in the re-feeding storage chamber 34 while it is turned only once by the tumbling unit 3.

Parts list

1. print unit
2. roll media feeding devices
3. tumbler unit
4. pedestal
5. wheels
6. receiving basket
7. medium roll
8. brake mechanism
9. de-curling roller
10. receiving medium, receiver web or receiver sheet
11. printer drive roller
12. printer pinch roller
13. (rear) pinch roller
14. suction plate
15. suction holes
16. print head
17. sensor
18. shuttle
19. front pinch roller
20. front drive roller
21. driving mechanism
22. driver disc
23. tumbler chassis
24. rotatable platform
25. position locking mechanism
26. position locking pin
27. hole in chassis
28. position block
29. lowering mechanism
30. nip
31. cam
32. driver disc locking mechanism
33. driver disc locking pin
34. re-feeding storage chamber
35. hole in driver disc
36. entrance slit
37. alignment sensor
38. alignment sensor

What is claimed is:

1. A printing apparatus comprising a print unit having a print head for printing an image on a receiving medium;

medium supply means for feeding said receiving medium to said print unit a medium alignment system having at least one alignment sensor for determining the alignment of said receiving medium in said print unit;

an alignment correction system for correcting said alignment;

a tumbler unit coupled to said print unit, for reversing said receiving medium, comprising pinch rollers each for forming a nip with a corresponding drive roller;

wherein said tumbler unit further has means for changing the orientation of said nip thereby reversing said receiving medium.

2. The apparatus according to claim 1 wherein said alignment correction system comprises at least two drive roller for independently driving said receiving medium.

3. The apparatus according to claim 2 wherein said alignment correction system is located inside said tumbler unit.

4. The apparatus according to claim 2 wherein said corresponding drive rollers serve as drive rollers for said alignment correction system.

5. The apparatus according to claim 1 wherein said pinch rollers are on a rotatable platform and the tumbler unit has means for locking the rotatable platform at different positions.

6. The apparatus according to claim 5 further comprising locking means for coupling said rotatable platform to at least one of said drive rollers providing synchronous rotation of said rotatable platform with said drive roller.

7. The apparatus according to claim 1 wherein said medium supply means is a device for feeding a medium from a roll, said device comprising a de-curling roller.

8. Method for printing images on a front and back side of a receiving medium comprising the steps of:

feeding the receiving medium to a print unit having a print head;

printing a first image on said front-side using said print head;

feeding the receiving medium between pinch rollers and corresponding drive rollers inside a tumbler unit, each pinch roller and corresponding drive roller forming a nip;

reversing said receiving medium in said tumbler unit by changing the orientation of said nip;

re-feeding said receiving medium to said print unit;

sensing the alignment of said receiving medium by at least one alignment sensor;

correcting said alignment of said receiver medium prior to printing said image on said back-side;

printing a second image on the back-side using said print head.

9. The method of claim 8, wherein the re-feeding of the receiving medium is done in a stepwise manner removing receiving medium buckle during backward stepping.

* * * * *